US007143754B2

(12) United States Patent
Girard

(10) Patent No.: US 7,143,754 B2
(45) Date of Patent: Dec. 5, 2006

(54) DEVICE COMPRISING A CYLINDER HEAD AND ITS COVER, MOUNTED ON THE ENGINE BLOCK, FOR DE-OILING OF WASTE GASES FROM COMBUSTION AND COMPRESSION

(75) Inventor: Didier Girard, Menucourt (FR)

(73) Assignee: Peugeot Citroen Automobiles S.A., Velizy Villacoublay (FR)

( * ) Notice: Subject to any disclaimer, the term of this patent is extended or adjusted under 35 U.S.C. 154(b) by 25 days.

(21) Appl. No.: 10/968,356

(22) Filed: Oct. 20, 2004

(65) Prior Publication Data

US 2005/0092268 A1 May 5, 2005

(30) Foreign Application Priority Data

Oct. 28, 2003 (FR) ..... 03 12598

(51) Int. Cl.
*F02M 25/06* (2006.01)

(52) U.S. Cl. ..... 123/572

(58) Field of Classification Search ..... None
See application file for complete search history.

(56) References Cited

U.S. PATENT DOCUMENTS 4,667,647 A 5/1987 Ohtaka et al.
5,307,784 A 5/1994 Choma et al.
2003/0150437 A1 8/2003 Nakamizo et al.

FOREIGN PATENT DOCUMENTS

| | | |
|---|---|---|
| DE | 37 04 567 | 8/1988 |
| EP | 0 454 512 | 10/1991 |
| EP | 1 227 237 | 7/2002 |

*Primary Examiner*—Andrew M. Dolinar
(74) *Attorney, Agent, or Firm*—Leydig, Voit & Mayer, Ltd.

(57) ABSTRACT

A device comprising a cylinder head and its cover for mounting onto an engine block of an internal combustion engine are disclosed, wherein a passageway arranged in the cylinder head cover ensures the circulation of gases loaded with oil in a chamber which is lined with alternately opposing walls that define baffles, until completely de-oiling, by settling, the gases which arrive on the bottom wall of the cylinder head cover situated downstream from baffles. The settled oil passes through openings of bottom wall and returns towards an oil core of the cylinder head, while the de-oiled gases are routed downstream from an intake valve by a set of ducts. The device makes it possible to completely integrate the circulation, de-oiling and return of the gases to the intake, inside the cylinder head.

9 Claims, 9 Drawing Sheets

DEVICE COMPRISING A CYLINDER HEAD AND ITS COVER, MOUNTED ON THE ENGINE BLOCK, FOR DE-OILING OF WASTE GASES FROM COMBUSTION AND COMPRESSION

The invention relates to a device made up of a cylinder head and its cover, intended for mounting on an engine block of an internal combustion engine.

It is known that the waste gases coming from combustion and compression penetrate the bottom of an internal combustion engine by leaks in the segmentation, regardless of the condition of this segmentation. Now these gases are loaded with oil, water and unburned fuel and, because of pollution control standards, these gases cannot be thrown back into the atmosphere.

In an arrangement of known type, such waste gases are de-oiled in an oil separator and are then recycled to the intake manifold upstream and downstream from the throttle valve, and they circulate in rubber tubes fit over end pieces and maintained by collars. These gases must be heated in order to avoid icing and ice-crystals formation capable of obstructing their passage, which would bring about a rise in pressure of the gases in the case, blowing out of the crankshaft joints and general destruction of the engine due to absence of oil. Two electric heaters are therefore mounted on the connectors.

Such an arrangement is relatively difficult to implement, and the present invention aims to remedy this difficulty by completely integrating the circulation, de-oiling and return of the gases to the intake inside the cylinder head.

The device according to the invention, is made up of a cylinder head and its cover, which are intended to be mounted on the engine block of an internal combustion engine, and is characterized by the fact that the cylinder head and its cover have, integrated within them, first passages making it possible to ensure, particularly for waste gases loaded with oil and coming from combustion and compression, their circulation up to an upper chamber of the cylinder head for housing of the camshaft of the engine and in which the gases are partially de-oiled by settling, the settled oil re-descending into the oil core of the cylinder head through perforations made in the part separating said core from the chamber for housing the camshaft, a passageway arranged in the cylinder head cover ensuring the circulation of the partially de-oiled gases from the chamber for housing the camshaft through a chamber of the cylinder head cover, which is lined with alternately opposing walls that define baffles or similar, until completely de-oiling, by settling, the gases that arrive on a bottom wall of the cylinder head cover chamber, situated downstream from the baffles, the settled oil passing through openings of this bottom wall and falling back into the chamber for housing the camshaft, and by the fact that the cylinder head cover has, in its upper part, a chamber for collection of the previously de-oiled gases, which are routed, by a set of ducts formed in the cylinder head cover and the cylinder head, downstream from an intake valve mounted in the cylinder head.

According to other advantageous characteristics of the invention:

- the first passages successively include openings made in the tablature of the cylinder head, a chamber of the cylinder head, and ducts formed in the cylinder head plate and opening at the upper part of the chamber for housing the camshaft;

- the set of ducts, formed in the cylinder head and the cylinder head cover, opens downstream from the valve by a collection cavity extended by a channel;
- the set of ducts, formed in the cylinder head and the cylinder head cover, opens downstream from the valve by a borehole extended by a channel;
- the collection cavity consists of a rough-cast cavity;
- the borehole is produced after molding the engine block;
- the set of ducts formed in the cylinder head cover and the cylinder head is produced by perforation, drilling, pin lifting or sand core drawback in a mold;
- the set of ducts, formed in the cylinder head and the cylinder head cover, opens downstream from the intake valve behind this valve;
- the set of ducts, formed in the cylinder head and the cylinder head cover, opens downstream from the intake valve in front of this valve.

The invention will be better understood and other aims, characteristics, details and advantages of it will appear more clear in the course of the following explanatory description given in reference to the appended drawings, which are given only by way of example illustrating an embodiment of the invention and in which.

Figure 1:
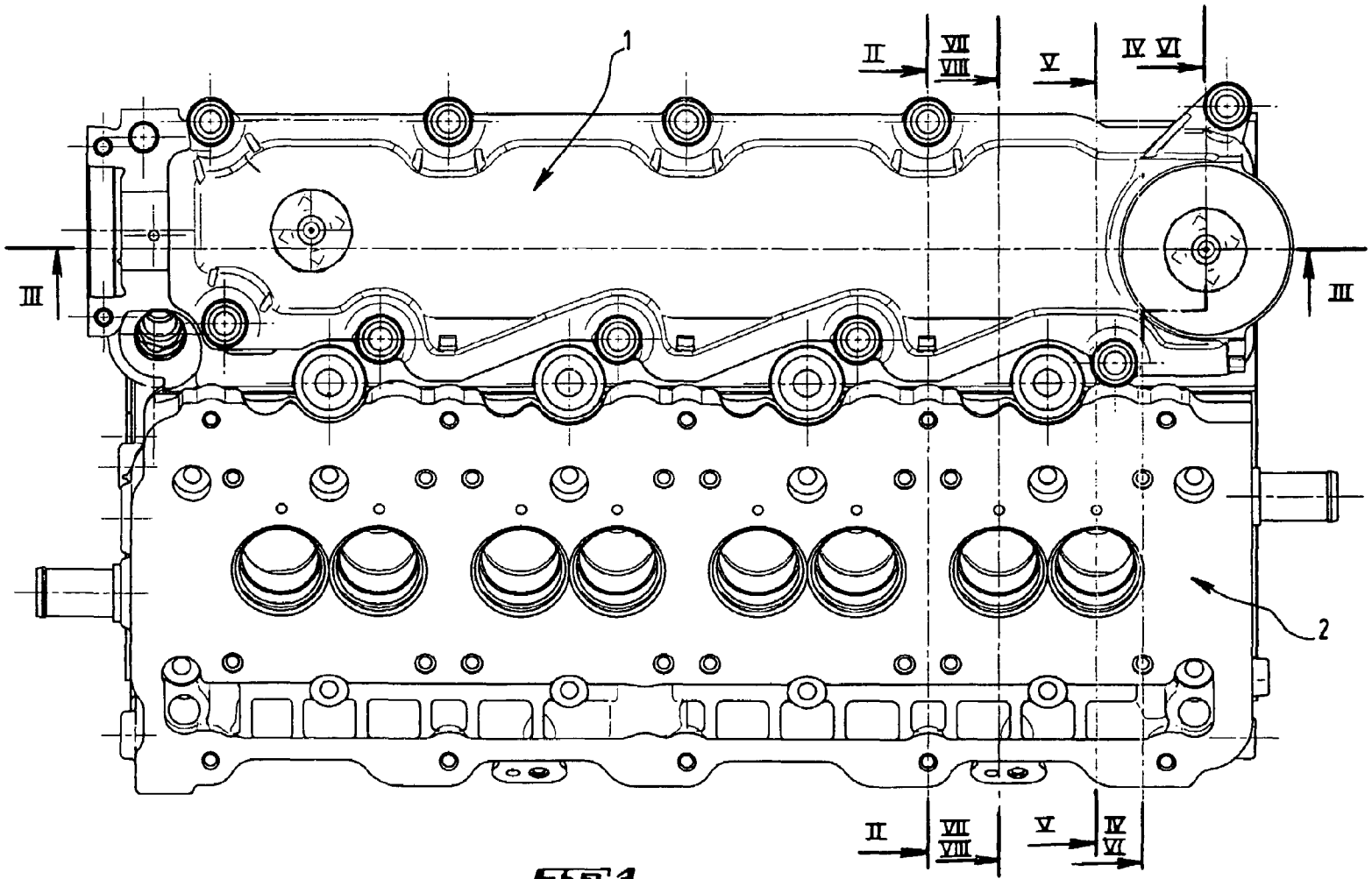
FIG. 1 is a general top view of the cylinder head and associated engine block according to the invention.

Represented in a general manner in FIG. 1 is a top view of the device according to the invention which has cylinder head 1 and its associated cylinder head plate 2. This figure thus described is in fact only given in order to show the correspondence with the cross sections in FIGS. 2 to 8 and is therefore not described further.

Figure 2:
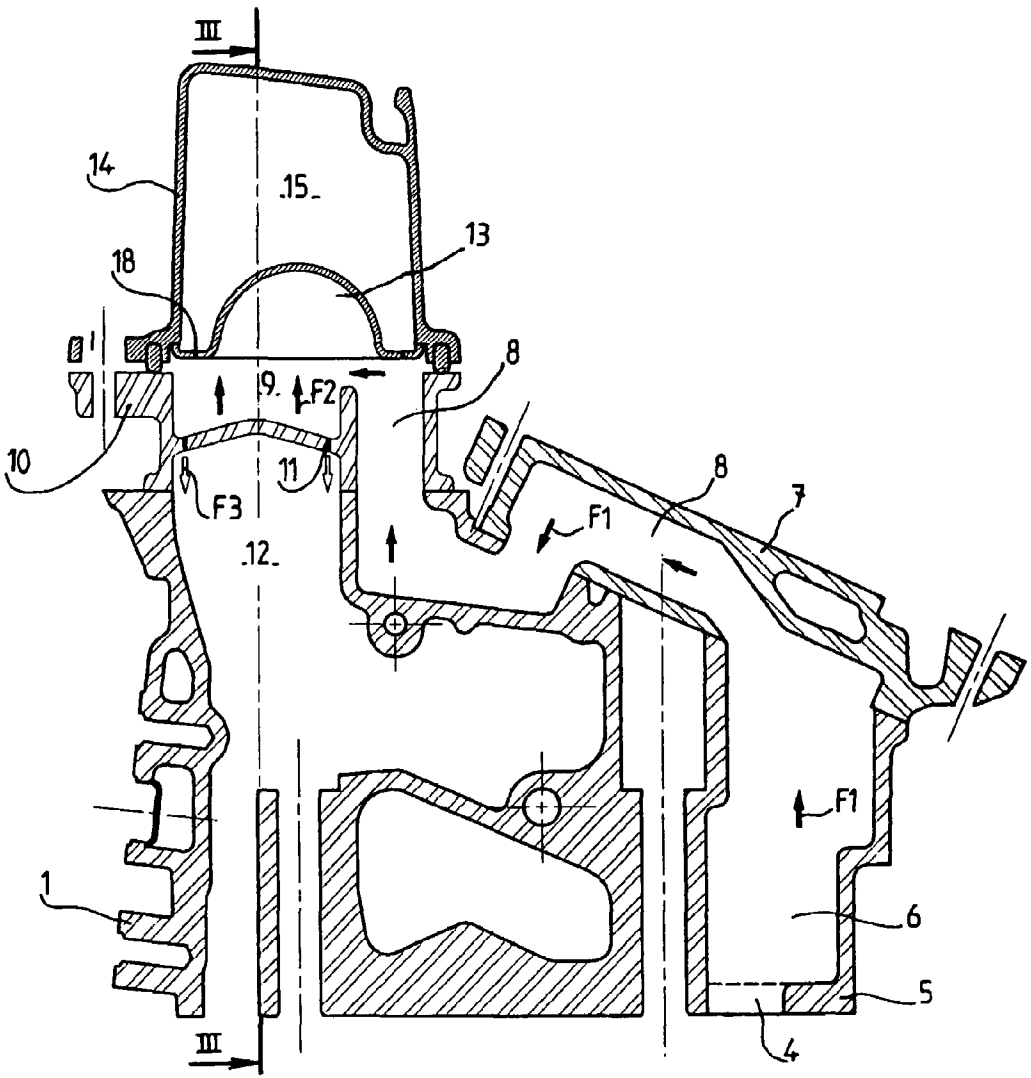
FIG. 2 is a cross section of the arrangement of FIG. 1 according to line II—II of this figure.

According to FIG. 2, the waste gases, called blow-by, coming from combustion and compression and loaded with water, fuel and, more particularly, oil, penetrate cylinder head 1 through openings 4 formed in tablature 5 of the cylinder head and arrive in chamber 6.

These gases rise according to arrows F1 through duct 8 formed in cylinder head plate 7, up to upper chamber 9 of cylinder head 1 which forms a housing for support 10 of the camshaft of the engine. The gases are then de-oiled a first time by settling in chamber 9 and rise according to arrows F2. Perforations 11 made in the upper part of oil core 12 of the cylinder head below camshaft holder 10 allow the oil thus collected to fall back down according to arrow F3 into oil core 12.

Figure 3:
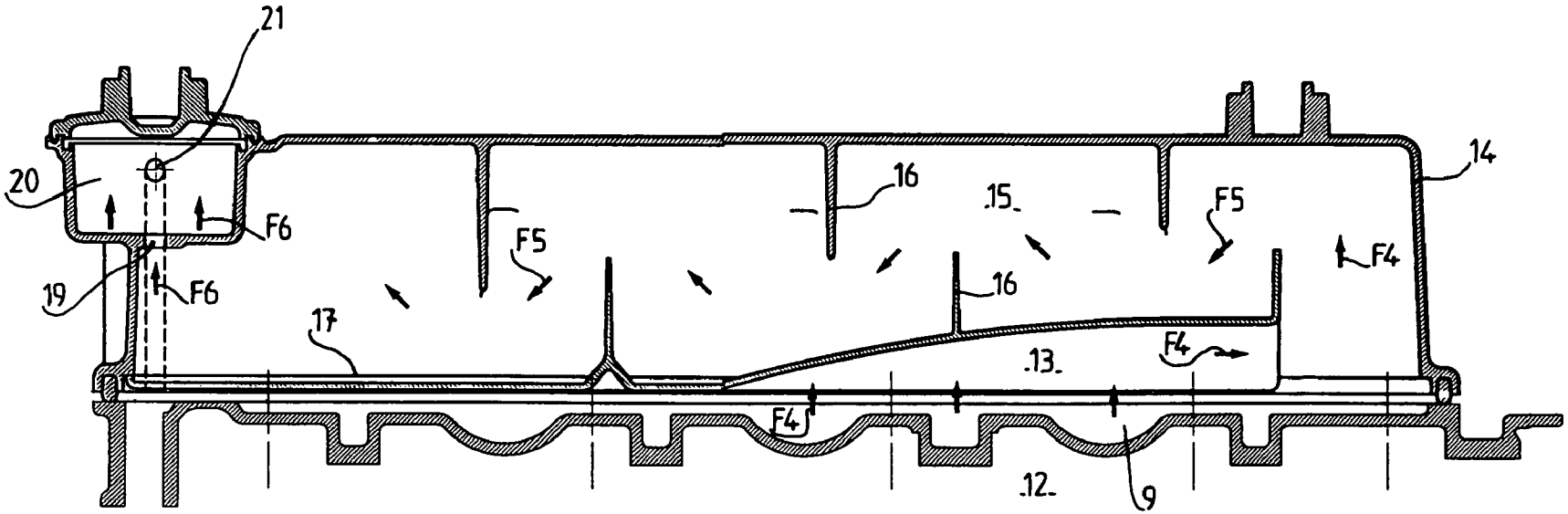
FIG. 3 is a cross section of the arrangement of FIG. 1 according to line III—III of this figure, also shown in FIG. 2.

Passageway 13, which can also be seen in FIG. 3, arranged in cylinder head cover 14, allows the partially de-oiled gases to rise back according to arrows F4 and to be introduced into settling chamber 15. This settling chamber formed in cylinder head cover 14 has, as seen in FIG. 3, alternately opposing walls defining baffles or similar 16 forming a sort of labyrinth along this chamber. The passage of the gases according to arrow F5 into settling chamber 15 allows these gases, by following the path of this sort of labyrinth, to be completely de-oiled, the oil then depositing in bottom 17 of cylinder head cover 14 downstream from baffles 16 and running into the volume of chamber 9 of FIG. 2 through openings 18 formed in this bottom.

Figure 4:
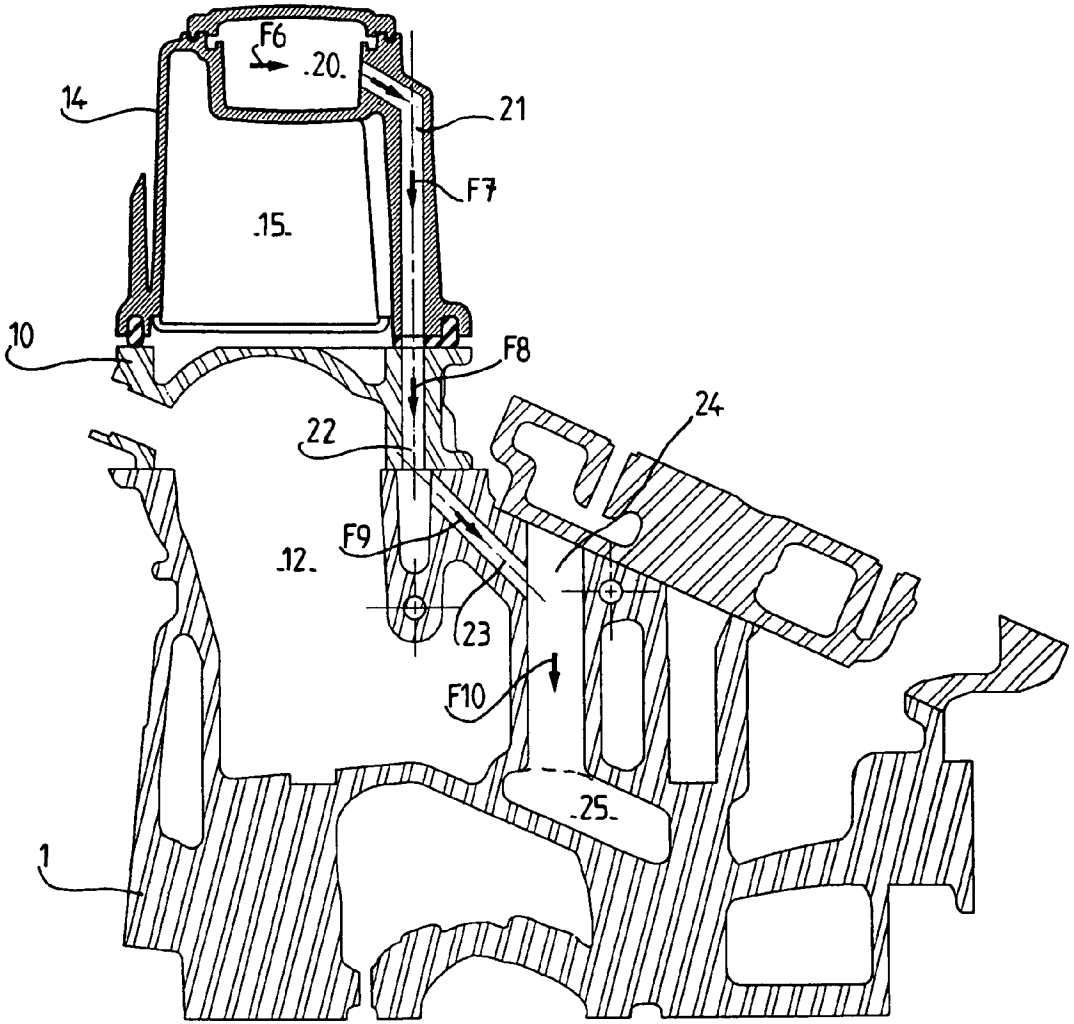
FIG. 4 is a cross section of the arrangement of FIG. 1 according to line IV—IV of this figure and shows a first process for producing a part of the channels according to the invention.

The gases completely de-oiled in this way rise back according to arrows F6 of FIGS. 3 and 4 and through opening 19 into collection chamber 20 formed at the upper part of cylinder head cover 14.

As seen in FIG. 4, these gases then come back out of chamber 20, according to arrow F7, through duct 21 formed in cylinder head cover 14 and pass through camshaft support 10 through duct 22 in order to be collected in cylinder head 1 according to arrow F8.

Figure 5:
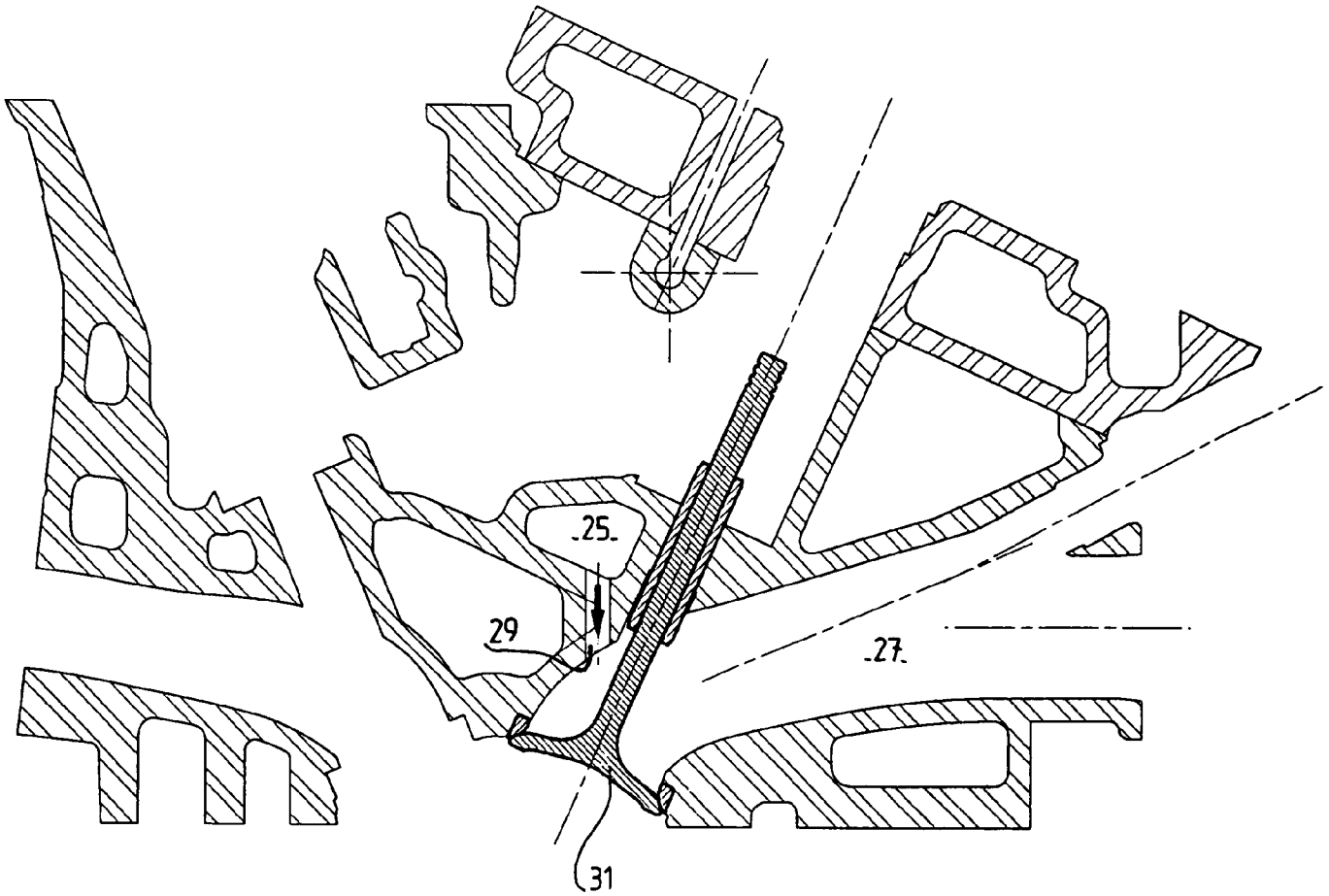
FIG. 5 is a cross section of the arrangement of FIG. 1 according to line V—V of this figure and corresponds to the first process above.

The de-oiled gases pass, according to arrow F9, through perforation 23 formed in cylinder head 1 and run into channel 24 according to arrow F10 in order to feed into rough-cast cavity 25 formed by core molding directly with the molding of the engine block according to a first process for formation of a part of the channels according to the invention and which is illustrated in FIGS. 4 and 5.

Figure 6:
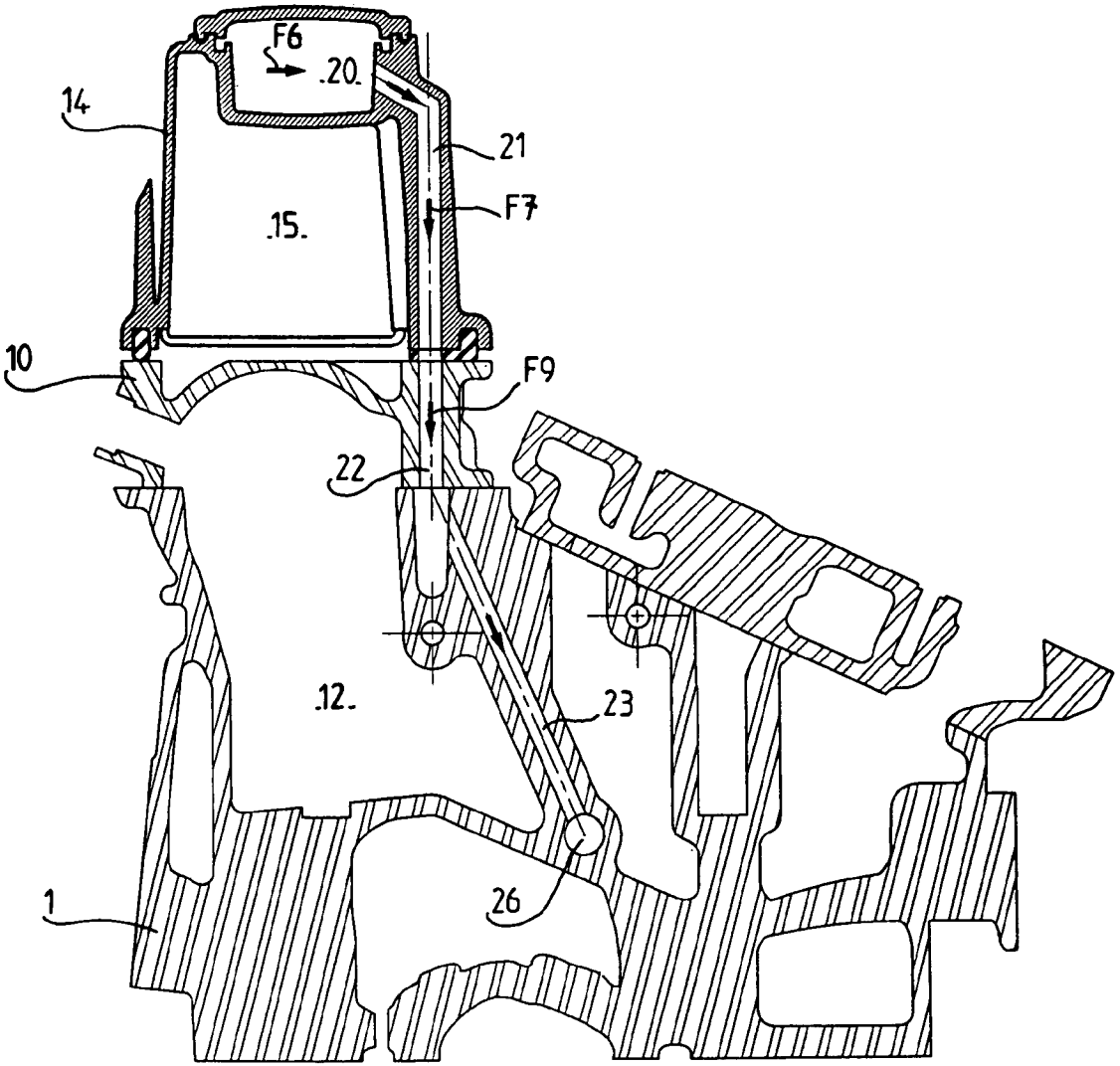
FIG. 6 is a cross section of the arrangement of FIG. 1 according to line VI—VI of this figure and shows a second process for producing a part of the channels according to the invention.
Figure 7:
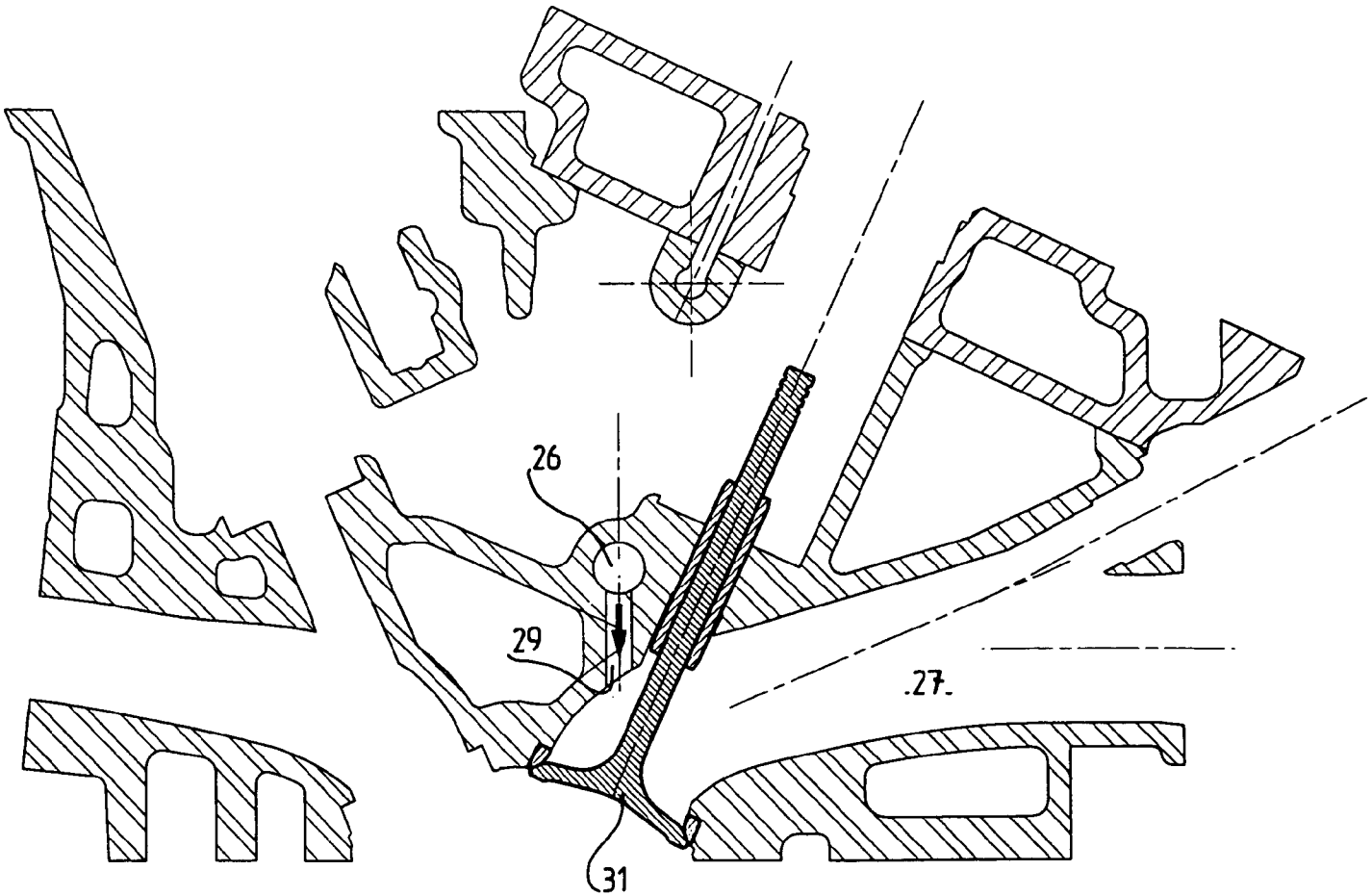
FIG. 7 is a cross section of the arrangement of FIG. 1 according to line VII—VII of this figure and corresponds to the second process above, showing the layout of the part of the channels "behind" the intake valve.

In contrast, according to the second process for formation of a part of the channels according to the invention, as shown in FIGS. 6 and 7, of which the elements similar to those of FIGS. 4 and 5 are indicated by the same reference numbers, the de-oiled gases which have passed through perforation 23 feed borehole 26 produced after molding of the engine block.

According to FIG. 5, the distribution of the de-oiled gases occurs in intake ducts 27 coming from cavity 25 of FIG. 4, and according to FIG. 7, this distribution occurs in intake ducts 27 coming from borehole 26 of FIG. 6. Depending on the chosen process, the distribution is then ensured either by the length of borehole 26 or by the length of rough-cast cavity 25 and by openings or channels 29 (FIGS. 5 and 7) opening downstream from intake valve 31.

Figure 8:
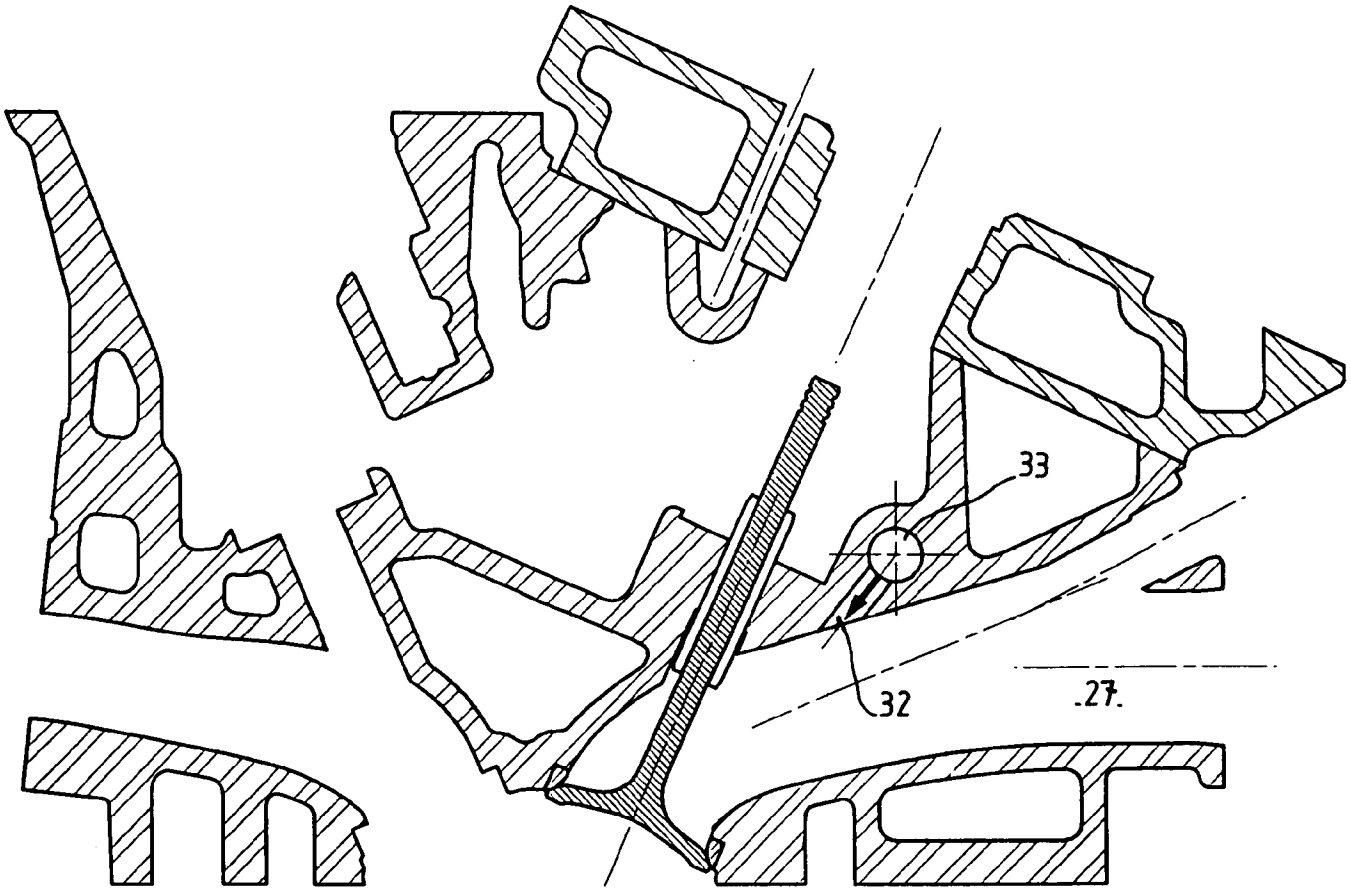
FIG. 8 is a cross section of the arrangement of FIG. 1 according to line VIII—VIII of this figure and also corresponds to the second process above, but shows the layout of the part of the channels "in front of" the intake valve.
Figure 9:
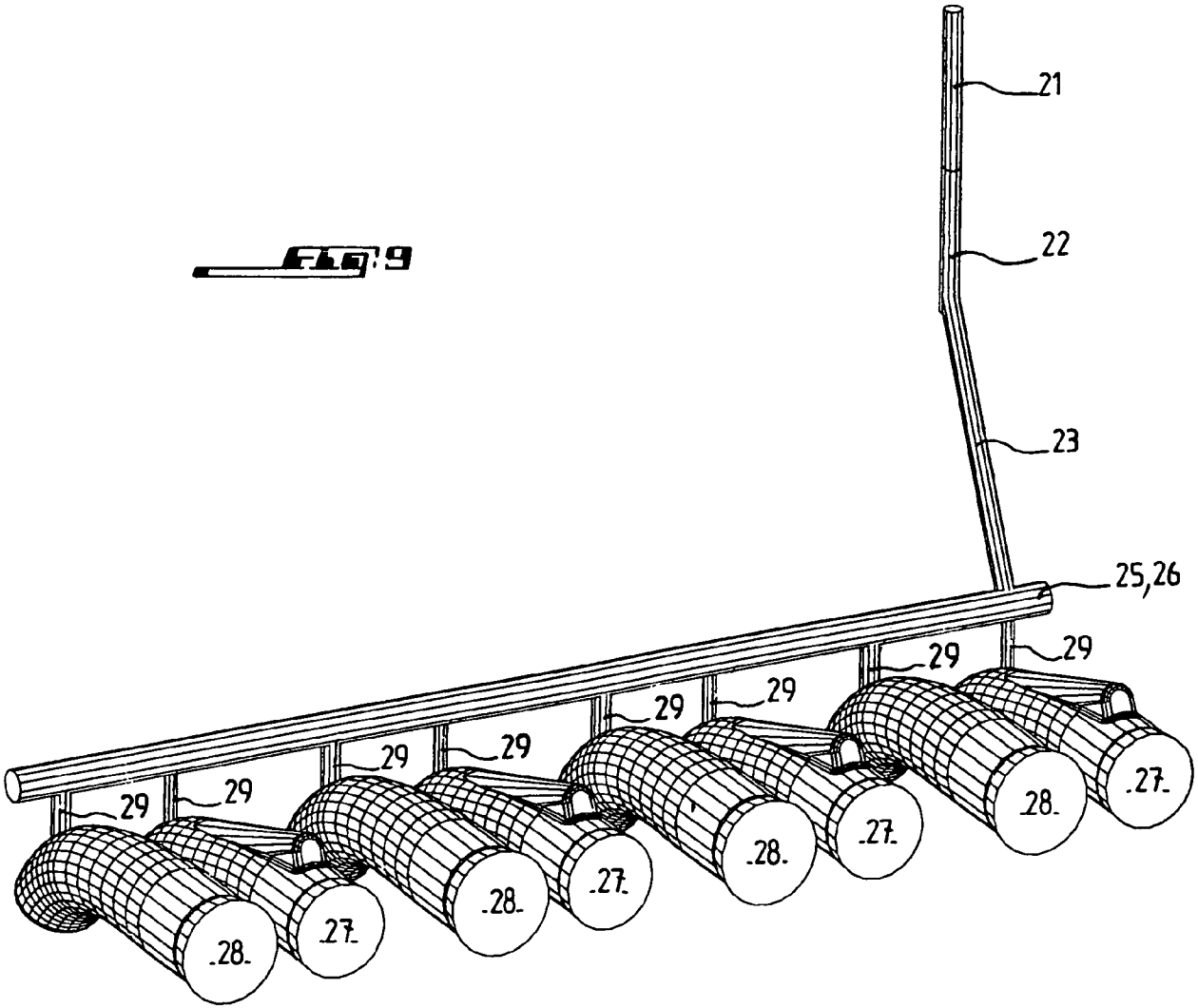
FIG. 9 diagrammatically shows the layout of the different ducts, perforations and holes of the preceding figures.

It should be noted moreover that FIG. 7, on one hand, and FIG. 8, on the other hand, both of which correspond to said second process, show two different layouts of the part of the intake channels for the de-oiled gases at the site of intake valve 31.

Thus, FIG. 7 shows a layout of the channel "behind" intake valve 31, that is to say downstream from intake duct 27. This layout corresponds to the preferred embodiment. It has been observed in effect that the zone on which the de-oiled gases coming from channel 29 where the gases come out, downstream from intake valve 31, is a zone of higher turbulence and allows better distribution of the gases in the intake air.

In contrast, FIG. 8 shows a layout of the channel "in front of" intake valve 31. This channel is in this case referenced 32 and corresponds to channel 29 of FIG. 7, while being in connection with borehole 33 similar to borehole 26 of the latter figure.

The calibration of the different openings or channels 29, 32 as well as that corresponding to borehole 26 will be done as a function of the desired flow rates of gases in intake ducts 27 of FIG. 5 (tumble duct) and of FIGS. 7 and 8 (permeable duct).

Likewise, the holes or ducts such as 21, 22, 23, 26, 29, 32 and 33 can be produced by perforation, drilling, pin lifting or sand core drawback in a mold.

The invention claimed is:

1. A device comprising a cylinder head and a cylinder head cover, for mounting onto an engine block of an internal combustion engine, the cylinder head comprising an upper chamber, a camshaft housing, an oil core, and perforations, wherein the perforations are in a part of the cylinder head separating the oil core from the camshaft housing, the cylinder head cover comprising a passageway, a cylinder head cover chamber lined with alternately opposing walls defining baffles, a bottom wall having openings, and a collection chamber at an upper part of the cylinder head cover, wherein the cylinder head and the cylinder head cover have, integrated within them, first passages arranged to allow waste gases loaded with oil, the waste gases resulting from combustion and compression, to circulate up to the upper chamber of the cylinder head wherein the gases are partially de-oiled by settling, to provide settled oil that re-descends into the oil core through the perforations of the cylinder head, the passageway in the cylinder head cover being arranged to allow the circulation of the partially de-oiled gas from the upper chamber of the cylinder head through the cylinder head cover chamber comprising the baffles, until the gas is completely de-oiled by settling, to provide settled oil depositing on the bottom wall of the cylinder head cover chamber, downstream of the baffles, the settled oil passing through the openings of the bottom wall and into the upper chamber of the cylinder head, and the de-oiled gas passing into the collection chamber of the cylinder head cover, and wherein the cylinder head and cylinder head cover have a set of ducts arranged to allow de-oiled gases to be routed from the collection chamber of the cylinder head cover to the site of an intake valve mounted in the cylinder head.

2. The device according to claim 1, wherein the first passages successively include openings made in tablature of the cylinder head, in a lower chamber of the cylinder head, in ducts formed in a cylinder head plate, and opening at the upper part of chamber for the camshaft housing.

3. The device according to claim 1, wherein the set of ducts, formed in the cylinder head and the cylinder head cover, opens at the site of the intake valve by a collection cavity extended by a channel.

4. The device according to claim 1, wherein the set of ducts, formed in the cylinder head and the cylinder head cover, opens at the site of the intake valve by a borehole extended by a channel.

5. The device according to claim 3, wherein the collection cavity consists of a rough-cast cavity.

6. The device according to claim 4, wherein the borehole is produced after molding of the engine block.

7. The device according to claim 1, wherein the set of ducts, formed in the cylinder head cover and the cylinder head, is produced by perforation, drilling, pin lifting or sand core drawback in a mold.

8. The device according to claim 1, wherein the set of ducts, formed in the cylinder head and the cylinder head cover, opens at the site of the intake valve behind the valve.

9. The device according to claim 1, wherein the set of ducts, formed in the cylinder head and the cylinder head cover, opens at the site of the intake valve in front of the valve.

* * * * *